US008596991B2

(12) United States Patent
Dalton

(10) Patent No.: US 8,596,991 B2
(45) Date of Patent: Dec. 3, 2013

(54) THERMALLY EFFICIENT MULTIPLE STAGE GEAR PUMP

(75) Inventor: William H. Dalton, Amston, CT (US)

(73) Assignee: Triumph Engine Control Systems, LLC, West Hartford, CT (US)

( * ) Notice: Subject to any disclaimer, the term of this patent is extended or adjusted under 35 U.S.C. 154(b) by 123 days.

(21) Appl. No.: 12/931,830

(22) Filed: Feb. 11, 2011

(65) Prior Publication Data

US 2012/0207626 A1 Aug. 16, 2012

(51) Int. Cl.
*F04B 25/00* (2006.01)

(52) U.S. Cl.
USPC ..... 417/253; 417/201; 417/248

(58) Field of Classification Search
USPC ..... 417/248, 253, 201, 203, 205
See application file for complete search history.

(56) References Cited

U.S. PATENT DOCUMENTS 2,595,618 A * 5/1952 Vogt et al. ..... 417/286
6,375,435 B2 4/2002 Sundberg et al.
6,442,925 B1 9/2002 Dalton et al.
6,474,938 B2 11/2002 Dalton et al.
6,623,250 B2 9/2003 Zagranski et al.
6,634,865 B2 10/2003 Dalton
6,663,357 B2 12/2003 Dalton et al.
6,719,543 B2 4/2004 Gentile et al.
6,786,702 B2 9/2004 Zagranski et al.
6,821,093 B2 11/2004 Zagranski et al.
6,962,485 B2 11/2005 Bennett et al.
6,996,969 B2 2/2006 Dalton et al.
7,083,394 B2 8/2006 Dalton
7,207,785 B2 4/2007 Dalton et al.
7,770,388 B2 8/2010 Desai
8,277,208 B2 10/2012 Paluszewski et al.
2004/0213680 A1 * 10/2004 Suzuki et al. ..... 417/310

* cited by examiner

*Primary Examiner* — Charles Freay
*Assistant Examiner* — Philip Stimpert
(74) *Attorney, Agent, or Firm* — Dann, Dorfman, Herrell & Skillman, PC

(57) ABSTRACT

A multiple stage pump for delivering fuel to an engine is disclosed which includes a pump housing, a boost stage operable at engine start to draw fuel into the pump housing at a boost stage pressure, a first pumping stage operable upon engine start for receiving fuel from the boost stage and delivering the fuel from the pump housing to a fuel metering unit, a second pumping stage operable upon engine start and during engine cruise operation for receiving fuel from the boost stage and delivering the fuel from the pump housing to said fuel metering unit, and a switching valve in fluid communication with the first and second pumping stages, and configured to control fuel flow through the first pumping stage in dependence on changes in boost stage conditions such as pressure or shaft speed.

24 Claims, 4 Drawing Sheets

THERMALLY EFFICIENT MULTIPLE STAGE GEAR PUMP

BACKGROUND OF THE INVENTION

1. Field of the Invention

The subject invention is directed generally to fuel delivery systems for gas turbine engines, and more particularly, to a thermally efficient multiple stage fixed displacement gear pump for use in aerospace engine applications.

2. Background of the Related Art

Single stage fixed displacement gear pumps are well known in the art and are often used in low horsepower aerospace applications for delivering fuel to a fuel metering unit of a gas turbine engine. These pumps are used to create pressure through the meshing of gear teeth, which forces fluid around the gears to the outlet side of the pump. In a gear pump, a drive mechanism delivers power to a driving gear. The driving gear then transmits the power to a meshing driven gear to perform work and move fluid through the pump.

Low energy consumption pumping systems are being developed in the aerospace industry as an alternative to traditional single stage fixed displacement gear pumps. One way of doing this is to divide the single pumping stage into multiple pumping stages that can be switched on and off at different operating regimes, depending upon the demand for fluid. These systems improve pump performance by reducing excess heat generated by the pumping gears of a single stage pump. However, each stage typically includes a separate set of gears and bearings, thus increasing the cost and weight of such a pumping system.

Because low cost and weight are critical factors in designing hardware for aerospace applications, it would be beneficial to provide a thermally efficient multiple stage fixed displacement gear pump that utilizes fewer component parts. The pumping system of the subject invention achieves this goal by sharing various mechanical components between pumping stages.

SUMMARY OF THE INVENTION

The subject invention is directed to a new and useful. low cost, light weight thermally efficient multiple stage gear pump for delivering fuel to a gas turbine engine used for aerospace applications. The multiple stage gear pump includes a pump housing, a boost stage having an impeller assembly operable at engine start to draw fuel into the pump housing through a fuel inlet at a boost stage pressure. A first set of pumping gears is operable upon engine start for receiving fuel from the boost stage and delivering the fuel from the pump housing to a fuel metering unit. A second set of pumping gears is operable upon engine start and during engine cruise operation for receiving fuel from the boost stage and delivering the fuel from the pump housing to the fuel metering unit.

The gear pump further includes a hydraulically actuated valve in fluid communication with the first and second sets of pumping gears, and configured to control fuel flow through the first set of pumping gears when the boost stage pressure rises to a predetermined level. The valve is also in fluid communication with the boost stage and it includes a spring biased valve element that motively reacts to fluid pressure changes generated at the boost stage. The valve prevents discharge flow from the first pumping stage when the boost stage pressure rises to a predetermined level. At such a time, the valve switches the first pumping stage to a low pressure recirculating fuel circuit within the pump housing.

The first set of pumping gears includes a driving start gear and a driven start gear, while the second set of pumping gears includes a driving cruise gear and a driven cruise gear. The pump further includes a main drive shaft that is operatively connected to the driving cruise gear. The driven start gear is piloted on a journal of the driving cruise gear. In addition, the driving start gear is threadably connected to a journal of the driven cruise gear.

The impeller assembly of the boost stage is mounted for axial rotation on a shaft operatively associated with a journal of the driving cruise gear. Preferably, a floating bearing set is shared between both sets of pumping gears and a fixed bearing set is associated with the second set of pumping gears.

These and other aspects of the multiple stage gear pumping system of the subject invention will become more readily apparent from the following detailed description of the preferred embodiments taken in conjunction with the drawings.

BRIEF DESCRIPTION OF THE DRAWINGS

So that those having ordinary skill in the art to which the subject invention pertains will more readily understand how to make and use the multiple stage gear pump assembly of the subject invention, preferred embodiments thereof will be described in detail hereinbelow with reference to the drawings, wherein.

DETAILED DESCRIPTION OF THE PREFERRED EMBODIMENTS

Figure 1:
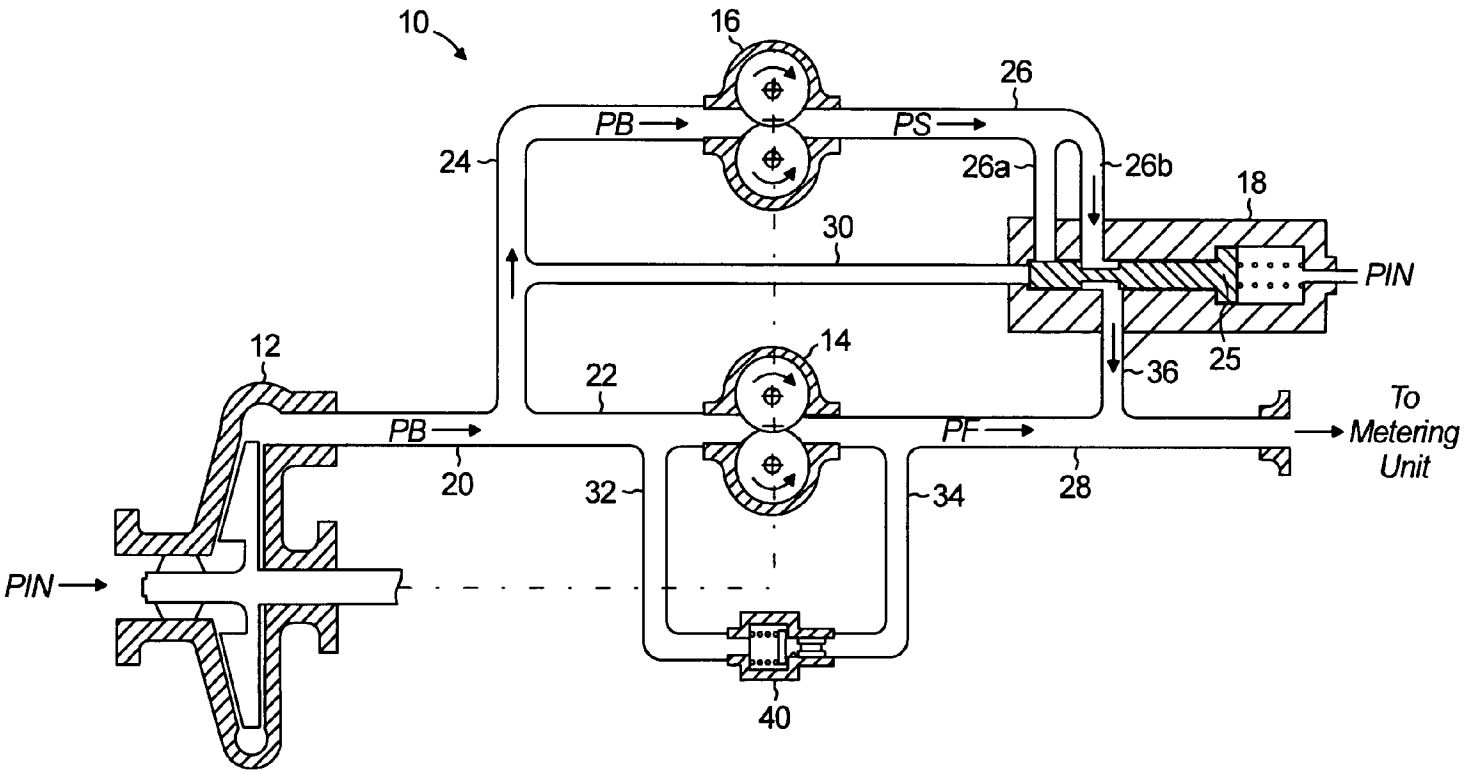
FIG. 1 is a schematic representation of the multiple stage gear pump assembly of the subject invention during engine start-up when the primary and secondary gear sets are operating together to deliver fuel to the fuel metering unit of a gas turbine engine.

Referring now to the drawings wherein like reference numerals identify similar structural elements or features, there is schematically illustrated in FIG. 1 a multiple stage pump system constructed in accordance with a preferred embodiment of the subject invention and designated generally by reference numeral 10. Pump system 10 is designed for use in aerospace applications, and more particularly, for delivering fuel to a hydro-mechanical fuel metering unit associated with a gas turbine engine. However, those skilled in the art will readily appreciate that the multiple stage pump system disclosed herein can be employed in applications outside of the aerospace industry.

Referring to FIG. 1, pump system 10 includes a boost stage 12 which functions to draw fuel into the system from a fuel source, a primary gear pump stage 14 for delivering pressurized fuel to a fuel metering unit over the entire engine operating regime, and a secondary gear pump stage 16 for delivering pressurized fuel to the fuel metering unit only during engine start up. The system 10 further includes a hydraulically actuated shuttle valve 18 that is adapted and configured to control the fuel flow through the secondary pump stage 16, in dependence upon fluid pressure changes occurring at the boost stage 12, as discussed in greater detail below.

It is envisioned that alternative devices can be employed to control the flow of fluid through the secondary pump stage 16 in dependence upon changing conditions at the boost stage. For example, a solenoid valve could be employed in conjunction with a speed sensor. The speed sensor would monitor changes in the pump shaft speed at the boost stage and communicate with the solenoid valve when the pump shaft speed reaches a predetermined value.

In operation, at engine start-up, the boost stage 12 receives fuel at an inlet pressure "PIN" which is essentially zero at the start condition. Fuel is delivered from the boost stage 12 to the primary and secondary pumping stages 12, 14 at a boosted pressure "PB" through main delivery conduit 20. More particularly, fuel at a boosted pressure "PB" is delivered from boost stage 12 to the primary gear pump stage 14 through fuel conduit 22, and fuel is delivered from boost stage 12 at boosted pressure "PB" to the secondary gear pump stage 14 through fuel conduit 24. Pressurized fuel is discharged from the primary gear pump stage 14 to the fuel metering unit at a pressure "PF" through outlet conduit 28. Pressurized fuel is discharged from the secondary gear pump stage 16 at a pressure "PS" through outlet conduit 26. Outlet conduit 26 is bifurcated into to outlet passages 26*a*, 26*b* that feed into the shuttle valve 18. During engine start-up, when the spring biased valve member 25 of shuttle valve 18 is in the open position shown in FIG. 1, fuel passages 26*a*, 26*b* both feed fuel into the valve body. Pressurized fuel exits the shuttle valve 18 and flows to the fuel metering unit through fuel conduit 36.

Shuttle valve 18 is in direct fluid communication with the boost stage 12 through intermediate fuel conduit 30. Pumping system 10 further includes a high pressure relief valve 40, which communicates with the low pressure side of the primary gear pump stage 14 through conduit 32 and with the high pressure side of primary gear pump stage 14 through a conduit 34.

Figure 2:
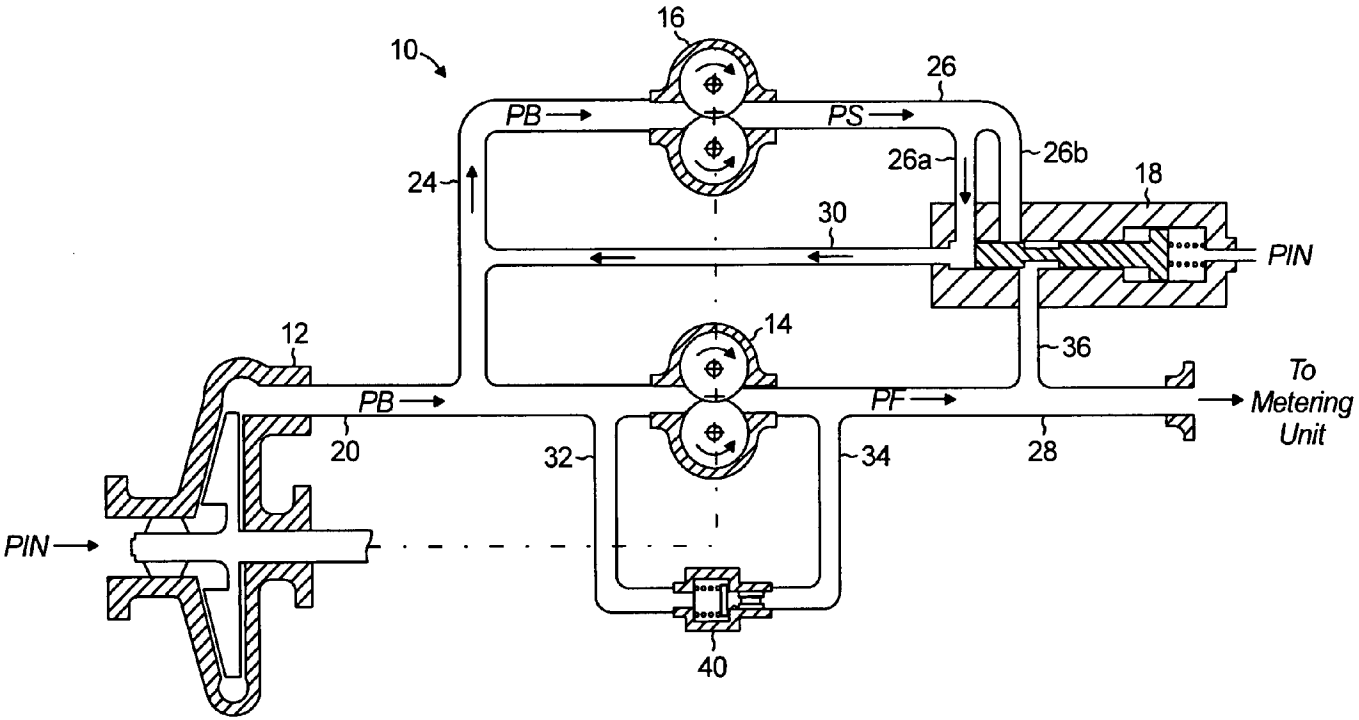
FIG. 2 is a schematic representation of the multiple stage gear pump assembly of the subject invention during engine cruise operation when only the primary gear set is delivering fuel to the fuel metering unit and the secondary gear set is in by-pass mode.

Referring to FIG. 2, as the pressure "PIN" at the boost stage 12 increases during the engine start-up cycle, the valve 18 senses the pressure rise and the spring loaded valve member 25 shuttles to a by-pass position. At such a time, the flow of fuel from the valve 18 to the fuel metering unit through fuel conduit 36 is blocked. In addition, the flow of fuel into the valve 18 through passage 26*b* is blocked. However, fuel from the secondary pump stage 16 continues to flow into valve 18 through fuel passage 26*a*. That fuel is then recirculated to the inlet side of the secondary pump stage 16 through conduit 30. The by pass flow through the secondary pumping stage is at a very low pressure, and therefore the work that is going into that fuel by the pump is relatively low, thereby improving the thermal efficiency of the system. When the valve 18 is closed and the secondary gear stage 16 is in by-pass mode, only fuel from the primary gear stage 14 is delivered to the fuel metering unit.

Figure 3:
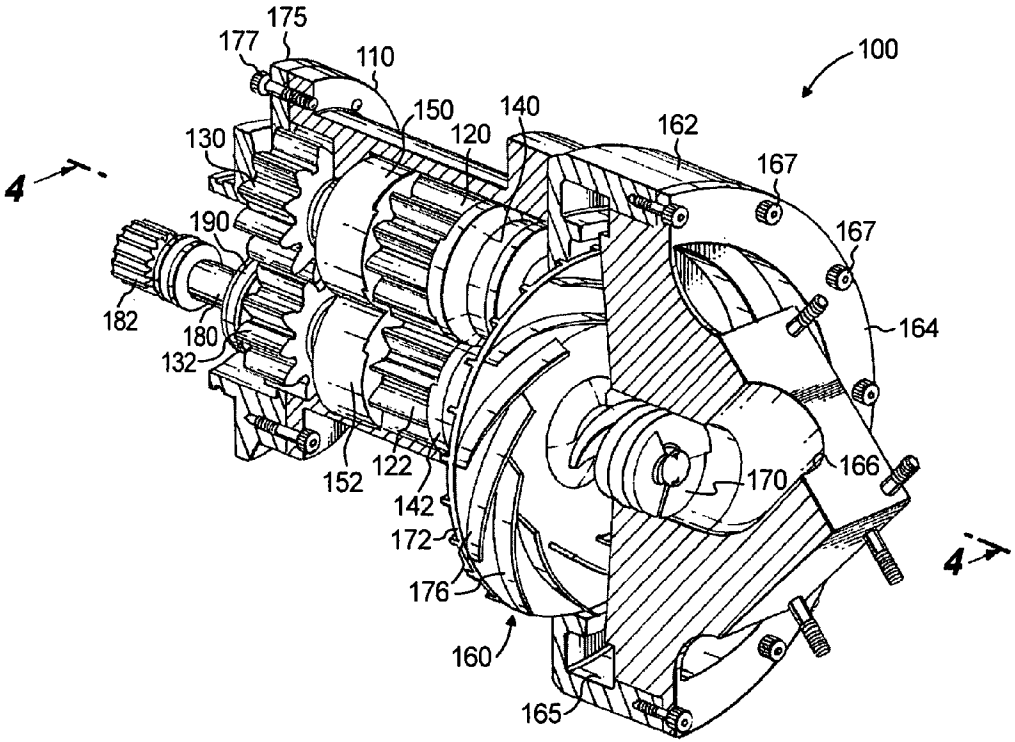
FIG. 3 is a perspective view of the multiple stage gear pump of the subject invention, with the pump housing sectioned to illustrate the boost stage impeller assembly, the primary and secondary pumping gear sets and the fixed and floating bearing sets that are housed therein.
Figure 4:
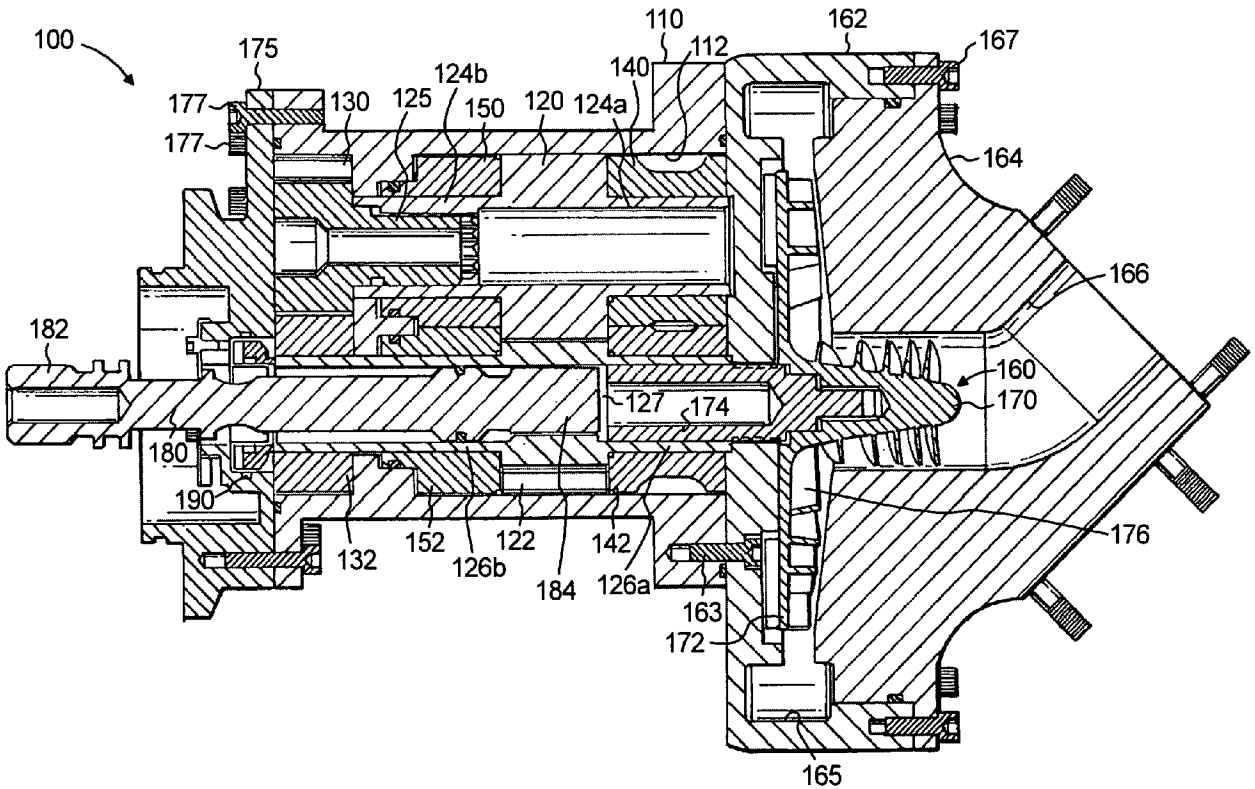
FIG. 4 is a cross-sectional view of the multiple stage gear pump of the subject invention, illustrating each component of the pump and the manner in which certain components are shared between the primary and secondary pumping stages.

Referring now to FIGS. 3 and 4, there is illustrated a preferred embodiment of a gear pump constructed in accordance with the subject invention and designated generally by reference numeral 100. Gear pump 100 includes a main pump housing 110 which defines an interior pumping chamber 112. The primary and secondary pump gear sets (14, 16) are housed within the pumping chamber 112 of pump housing 110. In essence, each gear set (14, 16) defines a positive displacement pump.

The primary gear set 14 (the engine cruise pumping gears) includes an upper primary gear 120 and a lower primary gear 122. The upper primary gear 120 is the driven gear, while the lower primary gear 122 is the driving gear. The secondary gear set 16 (the engine start pumping gears) includes an upper secondary gear 130 and a lower secondary gear 132. The upper secondary gear 130 is the driving gear, while the lower secondary gear 132 is the driven gear of the set.

As best seen in FIG. 4, the upper primary gear 120 has a front journal 124*a* and a rear journal 124*b*, while the lower primary gear 122 has a front journal 126*a* and a rear journal 126*b*. The lower secondary gear (the secondary drive gear) 132 is piloted by the lower primary gear (the primary drive gear) 122. More particularly, the lower secondary gear 132 is slip fit onto the rear journal 126*b* of the lower primary gear 122. In contrast, the upper secondary gear 130 is threadably or otherwise mechanically connected to a central bore 125 of the rear journal 124*b* of the upper primary gear 120. Consequently, the two gears (120, 130) spin together along a common axis during operation.

The interior pumping chamber 112 also houses two bearing sets. These include a fixed bearing set consisting of an upper fixed bearing 140 and a lower fixed bearing 142, and a floating bearing set consisting of an upper floating bearing 150 and a lower floating bearing 152. The upper fixed bearing 140 supports the front journal 124*a* of the upper primary gear 120, while the lower fixed bearing 142 supports the front journal 126*a* of the lower primary gear 122. The upper floating bearing 150 supports the rear journal 124*b* of the upper primary gear 120, while the lower floating bearing 152 supports the rear journal 126*b* of the lower primary gear 122. The floating bearings 150, 152 are loaded into the pump housing 110, between the primary and secondary gear sets to minimize leakage across the two stages. The floating bearing set 150, 152 is advantageously shared by the primary and secondary pump gear sets (14, 16), thereby reducing the overall number of component parts in gear pump 100.

Gear pump 100 further includes an impeller assembly 160 defining boost stage 12, which is contained within a boost housing 162 attached to the inlet side of pump housing 110 by threaded fasteners (e.g., fastener 163). Boost housing 162 is enclosed by a boost cover 164 attached by threaded fasteners 167. The boost cover 164 defines an inlet passage 166, while the boost housing 162 defines a boost chamber 165. Impeller assembly 160 includes an axial screw portion 170, an annular disk portion 172 and an elongated drive shaft 174. The screw portion 170 extends into the inlet passage 166 of boost cover 164 for drawing fuel into pump 100 through the inlet port 166. The impeller disk 172 is disposed within the impeller cavity 165 of boost housing 162 and has a plurality of circumferentially spaced impeller blades 176 thereon for imparting angular momentum to the fuel drawn into the pump 100. The drive shaft 174 of impeller assembly 160 is engaged within the central bore 127 of the lower primary gear 122 by brazing or other known joining techniques.

The impeller assembly 160 is adapted and configured to draw low pressure fuel into inlet passage 166, through the impeller cavity 165, and into the interior chamber 112 of pump housing 110, as illustrated schematically in FIGS. 1 and 2. At engine start-up, the impeller assembly 160 turns at a relatively low speed, and essentially produces no pressure. As the engine gains speed, the impeller speed increases, causing a resulting pressure rise at the boost stage. This pressure rise is sensed by the shuttle valve 18, causing the valve member 25 to move from the start position of FIG. 1 to the by-pass position of FIG. 2.

The pump 100 further includes an end plate 175 that is attached to pump housing 110 by threaded fasteners 177. An input shaft 180 is rotatably supported by the end plate 175 for driving the pumping gears. A shaft seal 190 is disposed between the end plate 175 and the pump housing 110 to prevent fuel leakage from the pumping chamber 112 relative to the input shaft 180. The input shaft 180 has opposed proximal and distal end portion 182 and 184. The proximal end portion 182 extends from the pump housing 110 and includes gear teeth for engaging a drive system associated with the engine (not shown). The distal end portion 184 is mechanically connected to the central bore 127 of the lower primary gear 122. Consequently, the input shaft 180 and the impeller drive shaft 174 are axially aligned with one another. Moreover, the input shaft 180 and the impeller assembly 160 rotate in unison during engine operation.

While the subject invention has been described with respect to preferred and exemplary embodiments, an in particular, with respect to a two-stage gear pump, those skilled in the art will readily appreciate that various changes and/or modifications can be made to the invention without departing from the spirit or scope of the invention as described herein, including for example, providing additional pump stages for different operating regimes.

What is claimed is:

1. A multiple stage pump for delivering fuel to an engine, comprising:

a) a pump housing;

b) a boost stage operable at engine start to draw fuel into the pump housing at a boost stage pressure;

c) a first pumping stage operable upon engine start for receiving fuel from the boost stage and delivering the fuel from the pump housing to a fuel metering unit, the first pumping stage having a driving start gear and a driven start gear, d) a second pumping stage operable upon engine start and during engine cruise operation for receiving fuel from the boost stage and delivering the fuel from the pump housing to said fuel metering unit, the second pumping stage having a driving cruise gear and a driven cruise gear, wherein the driving start gear of the first pumping stage is threadably connected to a journal of the driven cruise gear of the second pumping stage, and the driven start gear of the first pumping stage is piloted on a journal of the driving cruise gear of the second pumping stage;

e) a main drive shaft operatively connected to the driving cruise gear; and f) a hydraulically actuated valve in fluid communication with the first and second pumping stages, and configured to control fuel flow through the first pumping stage when the boost stage pressure rises to a predetermined level.

2. A multiple stage pump for delivering fuel to an engine as recited in claim 1, wherein the valve is in fluid communication with the boost stage and includes a spring biased valve element that motively reacts to changes in fluid pressure generated at the boost stage.

3. A multiple stage pump for delivering fuel to an engine as recited in claim 2, wherein the valve prevents discharge flow from the first pumping stage when the boost stage pressure rises to said predetermined level, and switches the first pumping stage to a recirculating fuel circuit within the pump housing.

4. A multiple stage pump for delivering fuel to an engine as recited in claim 1, wherein the boost stage includes an impeller mounted for axial rotation on a shaft operatively associated with the journal of the driving cruise gear.

5. A multiple stage pump for delivering fuel to an engine as recited in claim 1, wherein a floating bearing set is shared by the first and second pumping stages.

6. A multiple stage pump for delivering fuel to an engine as recited in claim 1, wherein a fixed bearing set is operatively associated with the second pumping stage.

7. A multiple stage pump for delivering fuel to an engine, comprising:

a) a pump housing;

b) a boost stage having an impeller assembly operable at engine start to draw fuel into the pump housing at a boost stage pressure;

c) a first set of pumping gears operable upon engine start for receiving fuel from the boost stage and delivering the fuel from the pump housing to a fuel metering unit, the first set of pumping gears including a driving start gear and a driven start gear;

d) a second set of pumping gears operable upon engine start and during engine cruise operation for receiving fuel from the boost stage and delivering the fuel from the pump housing to said fuel metering unit, the second set of pumping gears including a driving cruise gear and a driven cruise gear, wherein the driving start gear of the first set of pumping gears is threadably connected to a journal of the driven cruise gear of the second set of pumping gears, and the driven start gear of the first set of pumping gears is piloted on a journal of the driving cruise gear of the second set of pumping gears;

e) a main drive shaft operatively connected to the driving cruise gear; and f) a hydraulically actuated valve in fluid communication with the first and second sets of pumping gears, and configured to control fuel flow through the first set of pumping gears when the boost stage pressure rises to a predetermined level.

8. A multiple stage pump for delivering fuel to an engine as recited in claim 7, wherein the valve is in fluid communication with the boost stage and includes a spring biased valve element that motively reacts to fluid pressure changes generated at the boost stage.

9. A multiple stage pump for delivering fuel to an engine as recited in claim 8, wherein the valve prevents discharge flow from the first pumping stage when the boost stage pressure rises to said predetermined level, and switches the first pumping stage to a recirculating fuel circuit within the pump housing.

10. A multiple stage pump for delivering fuel to an engine as recited in claim 7, wherein the impeller assembly is mounted for axial rotation on a shaft operatively associated with the journal of the driving cruise gear.

11. A multiple stage pump for delivering fuel to an engine as recited in claim 7, wherein a floating bearing set is shared by the first and second sets of pumping gears.

12. A multiple stage pump for delivering fuel to an engine as recited in claim 7, wherein a fixed bearing set is operatively associated with the second set of pumping gears.

13. A multiple stage pump for delivering fuel to an engine, comprising:

a) a pump housing;

b) a boost stage operable at engine start to draw fuel into the pump housing at a boost stage pressure;

c) a first pumping stage operable upon engine start for receiving fuel from the boost stage and delivering the fuel from the pump housing to a fuel metering unit, the first pumping stage having a driving start gear and a driven start gear;

d) a second pumping stage operable upon engine start and during engine cruise operation for receiving fuel from the boost stage and delivering the fuel from the pump housing to said fuel metering unit, the second pumping stage having a driving cruise gear and a driven cruise gear, wherein the driving start gear of the first pumping stage is threadably connected to a journal of the driven cruise gear of the second pumping stage, and the driven start gear of the first pumping stage is piloted on a journal of the driving cruise gear of the second pumping stage; and e) a hydraulically actuated valve in fluid communication with the first and second pumping stages, and configured to control fuel flow through the first pumping stage when the boost stage pressure rises to a predetermined level.

14. A multiple stage pump for delivering fuel to an engine as recited in claim 13, wherein the valve is in fluid communication with the boost stage and includes a spring biased valve element that motively reacts to changes in fluid pressure generated at the boost stage.

15. A multiple stage pump for delivering fuel to an engine as recited in claim 14, wherein the valve prevents discharge flow from the first pumping stage when the boost stage pressure rises to said predetermined level, and switches the first pumping stage to a recirculating fuel circuit within the pump housing.

16. A multiple stage pump for delivering fuel to an engine as recited in claim 13, wherein the boost stage includes an impeller mounted for axial rotation on a shaft operatively associated with the journal of the driving cruise gear.

17. A multiple stage pump for delivering fuel to an engine as recited in claim 13, wherein a floating bearing set is shared by the first and second pumping stages.

18. A multiple stage pump for delivering fuel to an engine as recited in claim 13, wherein a fixed bearing set is operatively associated with the second pumping stage.

19. A multiple stage pump for delivering fuel to an engine, comprising:

a) a pump housing;

b) a boost stage having an impeller assembly operable at engine start to draw fuel into the pump housing at a boost stage pressure;

c) a first set of pumping gears operable upon engine start for receiving fuel from the boost stage and delivering the fuel from the pump housing to a fuel metering unit, the first set of pumping gears including a driving start gear and a driven start gear;

d) a second set of pumping gears operable upon engine start and during engine cruise operation for receiving fuel from the boost stage and delivering the fuel from the pump housing to said fuel metering unit, the second set of pumping gears including a driving cruise gear and a driven cruise gear, wherein the driving start gear of the first set of pumping gears is threadably connected to a journal of the driven cruise gear of the second set of pumping gears, and the driven start gear of the first set of pumping gears is piloted on a journal of the driving cruise gear of the second set of pumping gears; and e) a hydraulically actuated valve in fluid communication with the first and second sets of pumping gears, and configured to control fuel flow through the first set of pumping gears when the boost stage pressure rises to a predetermined level.

20. stage pump for delivering fuel to an engine as recited in claim 19, wherein the valve is in fluid communication with the boost stage and includes a spring biased valve element that motively reacts to fluid pressure changes generated at the boost stage.

21. A multiple stage pump for delivering fuel to an engine as recited in claim 20, wherein the valve prevents discharge flow from the first pumping stage when the boost stage pressure rises to said predetermined level, and switches the first pumping stage to a recirculating fuel circuit within the pump housing.

22. A multiple stage pump for delivering fuel to an engine as recited in claim 19, wherein the impeller assembly is mounted for axial rotation on a shaft operatively associated with the journal of the driving cruise gear.

23. A multiple stage pump for delivering fuel to an engine as recited in claim 19, wherein a floating bearing set is shared by the first and second sets of pumping gears.

24. A multiple stage pump for delivering fuel to an engine as recited in claim 19, wherein a fixed bearing set is operatively associated with the second set of pumping gears.

* * * * *